US010780558B2

(12) United States Patent
Dougherty

(10) Patent No.: US 10,780,558 B2
(45) Date of Patent: Sep. 22, 2020

(54) TOOL EXTENSIONS

(71) Applicant: Ingersoll-Rand Industrial U.S., Inc., Davidson, NC (US)

(72) Inventor: Thomas S. Dougherty, Nazareth, PA (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 1196 days.

(21) Appl. No.: 14/242,353

(22) Filed: Apr. 1, 2014

(65) Prior Publication Data

US 2015/0273669 A1 Oct. 1, 2015

(51) Int. Cl.

| | |
|---|---|
| ***B25B 23/16*** | (2006.01) |
| ***B25G 1/04*** | (2006.01) |
| ***B25B 23/00*** | (2006.01) |
| ***B25G 1/02*** | (2006.01) |

(52) U.S. Cl.

CPC ..... *B25B 23/0021* (2013.01); *B25G 1/02* (2013.01)

(58) Field of Classification Search

CPC ..... B25B 23/0021; B25B 23/0035; B25B 13/481; B25G 1/02; B25G 1/043; B25G 1/005

See application file for complete search history.

(56) References Cited

U.S. PATENT DOCUMENTS 4,664,100 A * 5/1987 Rudloff ..... A61F 2/26 600/40
4,876,929 A 10/1989 Kozak
4,923,057 A * 5/1990 Carlson ..... E04B 1/98 188/267.1
4,941,782 A 7/1990 Cook
5,185,934 A 2/1993 Tillman
5,284,330 A * 2/1994 Carlson ..... F16F 9/535 188/267.2
5,556,083 A * 9/1996 Furihata ..... B60G 17/025 267/277
5,607,996 A * 3/1997 Nichols ..... C08L 7/00 252/511
5,970,581 A 10/1999 Chadwick et al.
6,029,783 A * 2/2000 Wirthlin ..... F16F 9/532 188/267.1
6,434,237 B1 * 8/2002 Murray ..... H04M 1/6075 379/446

(Continued)

*Primary Examiner* — David B. Thomas

(74) *Attorney, Agent, or Firm* — Taft Stettinius & Hollister LLP

(57) ABSTRACT

Illustrative embodiments of tool extensions and methods of using such tool extensions are disclosed. In at least one illustrative embodiment, a tool extension may comprise a drive core configured to transfer rotational torque from a first end to a second end opposite the first end, where the first end is configured to be removably coupled to a tool to receive rotational torque from the tool, the second end is configured to be removably coupled to a fastener to supply rotational torque to the fastener, and the drive core is bendable between the first and second ends. The tool extension may further comprise a shell surrounding the drive core and containing an electro-rheological (ER) fluid configured to transition between a flexible state in which the shell permits bending of the drive core and a rigid state in which the shell resists bending of the drive core.

18 Claims, 6 Drawing Sheets

(56) References Cited

U.S. PATENT DOCUMENTS

| | | | | |
|---|---|---|---|---|
| 6,813,975 | B2 | 11/2004 | Kozak | |
| 6,926,089 | B2 | 8/2005 | Goodson, Jr. et al. | |
| 6,952,986 | B2 | 10/2005 | Fu | |
| 7,302,818 | B2 | 12/2007 | Usuzaki et al. | |
| 8,028,608 | B2 | 10/2011 | Sixto, Jr. et al. | |
| 8,117,950 | B2 | 2/2012 | Kozak et al. | |
| 2002/0157506 | A1* | 10/2002 | Schade | B25B 23/0021 81/177.6 |
| 2002/0185347 | A1 | 12/2002 | Pohl et al. | |
| 2006/0169090 | A1 | 8/2006 | Kozak et al. | |
| 2007/0060880 | A1* | 3/2007 | Gregorich | A61M 25/0045 604/96.01 |
| 2010/0223760 | A1 | 9/2010 | Henke et al. | |
| 2011/0083534 | A1 | 4/2011 | Kozak et al. | |
| 2012/0191076 | A1 | 7/2012 | Voegele et al. | |

* cited by examiner

TOOL EXTENSIONS

TECHNICAL FIELD

The present disclosure relates, generally, to tool extensions and, more particularly, to tool extensions including an electro-rheological (ER) fluid configured to alter the rigidity of the tool extension.

BACKGROUND

Many tools that are used for tightening and loosening fasteners may be difficult to fit into tight spaces. In particular, power tools and larger manually-operated tools may not be able to reach certain fasteners due to the size, length, and/or orientation of the tool head and the output drive. Tool extensions, which may more easily fit in some tight spaces, are sometimes used to transfer rotational torque from such tools to hard-to-reach fasteners. However, existing tool extensions typically have limited use, due in part to the fixed rigidity of these tool extensions.

SUMMARY

According to one aspect, a tool extension may comprise a drive core and a shell surrounding the drive core. The drive core may be configured to transfer rotational torque from a first end to a second end opposite the first end, where the first end is configured to be removably coupled to a tool to receive rotational torque from the tool, the second end is configured to be removably coupled to a fastener to supply rotational torque to the fastener, and the drive core is bendable between the first and second ends. The shell may contain an ER fluid configured to transition between a flexible state in which the shell permits bending of the drive core and a rigid state in which the shell resists bending of the drive core.

In some embodiments, the tool extension may further comprise one or more electrodes configured to selectively apply an electric field to the ER fluid to cause the ER fluid to transition from the flexible state to the rigid state. The tool extension may further comprise a power source coupled to the shell near the first end of the drive core. The power source may be configured to selectively supply an electric current to the one or more electrodes.

In some embodiments, the tool extension may further comprise one or more actuators configured to selectively apply a compressive force to the ER fluid to cause the ER fluid to transition from the flexible state to the rigid state. The one or more actuators may be configured to selectively apply the compressive force to the ER fluid by altering an internal volume of the shell containing the ER fluid. The shell may comprise an inner shell contacting the drive core and an outer shell surrounding the inner shell. The ER fluid may be disposed within an annular space between the inner and outer shells. The shell may further comprise a first end plate joining the inner and outer shells at the first end of the drive core and a second end plate joining the inner and outer shells at the second end of the drive core. One or both of the first and second end plates may comprise an electrode configured to selectively apply an electric field to the ER fluid to cause the ER fluid to transition from the flexible state to the rigid state.

In some embodiments, the second end of the drive core may be movable in three dimensions relative to the first end of the drive core when the ER fluid is in the flexible state. In some embodiments, the shell may be configured, when the ER fluid is in the rigid state, to apply a normal force to the drive core that promotes the transfer rotational torque from the first end of the drive core to the second end of the drive core. The second end of the drive core may be configured to be removably coupled to one of a plurality of differently sized tool elements to supply rotational torque to the fastener.

According to another aspect, a tool extension may comprise an inner shell, a drive core positioned in the inner shell, an outer shell surrounding the inner shell with a space therebetween, and an ER fluid disposed between the inner and outer shells. The drive core may be configured to rotate within the inner shell to transfer rotational torque from a first end of the drive core to a second end of the drive core. The drive core may be bendable between the first and second ends. The ER fluid may be disposed in the space between the inner and outer shells and may be configured to increase rigidity in the presence of an electric field to resist bending of the drive core.

In some embodiments, the first end of the drive core may be configured to be removably coupled to a tool to receive rotational torque from the tool. The second end of the drive core may be configured to be removably coupled to a fastener to supply rotational torque to the fastener. The tool extension may further comprise a first end plate joining the inner and outer shells at the first end of the drive core and a second end plate joining the inner and outer shells at the second end of the drive core. One of both of the first and second end plates may comprise an actuator configured to selectively apply a compressive force to the ER fluid to further increase the rigidity of the ER fluid.

According to yet another aspect, a method of using a tool extension may comprise coupling a first end of a drive core of the tool extension to a tool, where the drive core is surrounded by a shell containing an ER fluid, coupling a second end of the drive core to a fastener, bending the drive core into a desired geometric configuration, rigidizing the ER fluid of the tool extension to maintain the drive core in the desired geometric configuration, and operating the tool, after rigidizing the ER fluid, to provide rotational torque to the first end of the drive core such that the second end of the drive core supplies rotational torque to the fastener.

In some embodiments, rigidizing the ER fluid of the tool extension may comprise applying an electrical field to the ER fluid using one or more electrodes of the tool extension. Rigidizing the ER fluid of the tool extension may further comprise applying a compressive force to the ER fluid by decreasing an internal volume of the shell containing the ER fluid. Coupling the second end of the drive core to the fastener may comprise coupling the second end of the drive core to one of a plurality of differently sized tool elements and coupling the tool element to the fastener.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. The detailed description particularly refers to the accompanying figures in which.

DETAILED DESCRIPTION OF THE DRAWINGS

Figure 1A:
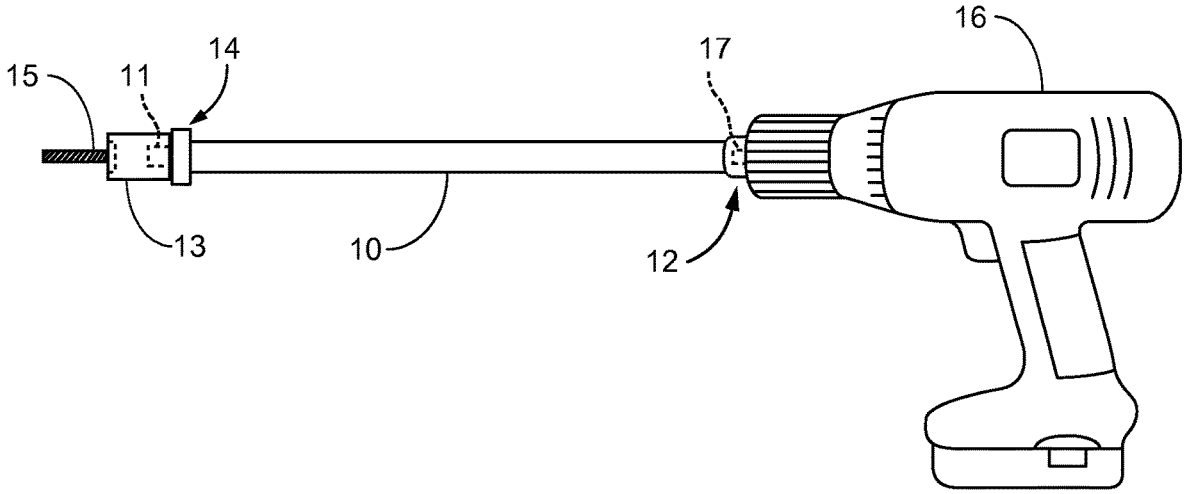
FIG. 1A is a side view of one illustrative embodiment of a tool extension removably coupled to a tool.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 1B:
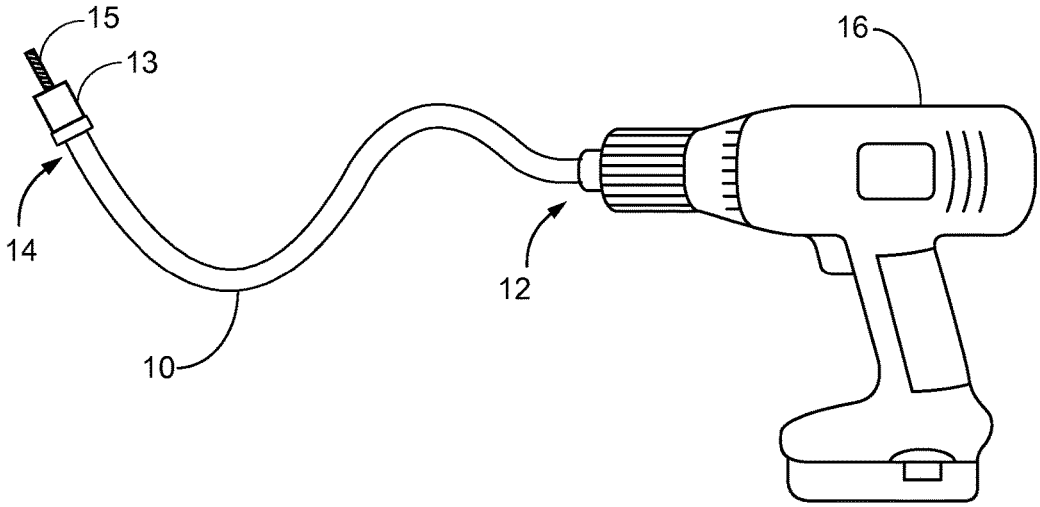
FIG. 1B is a side view of the tool extension and the tool of FIG. 1A, where the tool extension has been bent into a desired geometric configuration.

Referring now to FIGS. 1A and 1B, one illustrative embodiment of a tool extension 10 removably coupled to a tool 16 is shown in simplified diagrams. As described in detail below, the tool extension 10 may be used to transfer rotational torque from an output 17 of the tool 16 to a hard-to-reach fastener 15 (e.g., a fastener disposed in a tight space, where the tool 16 may not be able fit). Although the tool 16 is illustratively shown in FIGS. 1A and 1B as a battery-powered cordless driver tool, it will be appreciated that the presently disclosed tool extensions 10 may be used with any type of tool having a rotating output, including, but not limited to, other types of power tools (e.g., an electrically- or pneumatically-powered impact wrench) and manually-operated tools (e.g., a manual ratchet wrench).

As shown in FIGS. 1A and 1B, the tool extension 10 includes an input end 12 and an output end 14 opposite the input end 12. In the illustrative embodiment, the input end 12 is configured to be removably coupled to the tool 16 (e.g., to an output shaft 17 of the tool 16) to receive rotational torque from the tool 16. For instance, in some embodiments, such as those shown in FIGS. 2 and 5 (and further discussed below), the input end 12 of the tool extension 10 may be formed to include a recess 26 that is shaped to receive a square drive 17 of the tool 16.

The output end 14 of the tool extension 10 is configured to be removably coupled to a fastener 15 to supply rotational torque to the fastener 15. In some embodiments, the output end 14 may be shaped to directly engage a certain type or types of fasteners. For instance, in one illustrative embodiment, the output end 14 of the tool extension 10 may be adapted to directly engage the head of a Phillips-type screw 15. In other embodiments, to provide more versatility, the output end 14 may be configured to be indirectly coupled to a fastener 15 via one of a plurality of differently sized tool elements 13 in order to supply rotational torque to the fastener 15. In other words, in such embodiments, the plurality of differently sized tool elements 13 may be used interchangeably with the tool extension 10 to allow use of the tool extension 10 with a plurality of different types of fasteners 15. By way of example, as illustratively shown in FIGS. 1A and 1B, the output end 14 of the tool extension 10 may include a square drive 11. In such configurations, a user may removably couple a socket 13 (chosen from among a plurality of differently sized sockets 13) to the square drive 11 of the tool extension 10 and also engage the socket 13 with the fastener 15 to be tightened or loosened. It is also contemplated that, in still other embodiments, the output end 14 of the tool extension 10 may be formed to include a recess that is shaped to receive interchangeable tool elements 13 (e.g., differently sized screwdriver bits).

The tool extension 10 is shown in a straight (i.e., unbent) configuration in FIG. 1A and a bent configuration in FIG. 1B. As described in more detail below, the tool extension 10 is able to transition, under the control of a user, back-and-forth between flexible and rigid states. When in a flexible state, a user of the tool extension 10 may bend the tool extension 10 into any number of desired shapes or geometric configurations between its input and output ends 12, 14. For instance, when the tool extension 10 is in a flexible state, the user may bend the tool extension 10 from the configuration shown in FIG. 1A to that shown in FIG. 1B. It is contemplated that, in some illustrative embodiments, bending the tool extension 10 may involve moving the output end 14 in three dimensions relative to the input end 12. Once the user has bent the tool extension 10 into a desire shape or geometric configuration, the user may cause the tool extension 10 to transition to a rigid state to maintain that configuration (until the tool extension 10 is transitioned back to a flexible state).

Those skilled in the art will appreciate that terms like "flexible" and "rigid," as well as related terms, have relative meanings in the present disclosure. As such, the "rigid" state of the tool extension 10 will be characterized by greater stiffness than the "flexible" state, but not necessarily complete stiffness. Likewise, the "flexible" state of the tool extension 10 will be characterized by less stiffness than the "flexible" state, but not necessarily a complete lack of stiffness. In other words, terms like "rigid" and "flexible" are used herein to denote relative increases and decreases, respectively, in stiffness and the ability to hold or maintain a shape.

Figure 2:
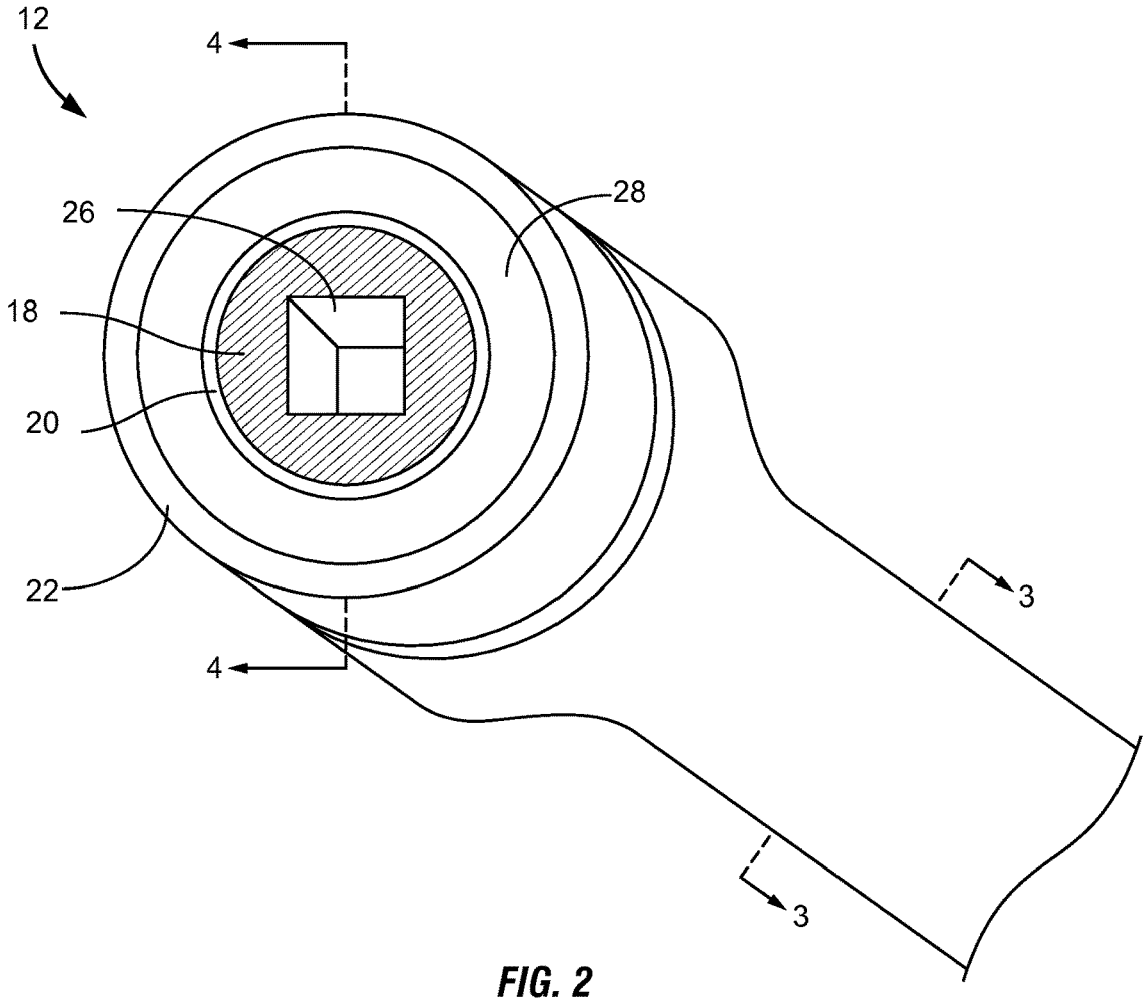
FIG. 2 is a perspective view of an input end of the tool extension of FIG. 1A.
Figure 3:
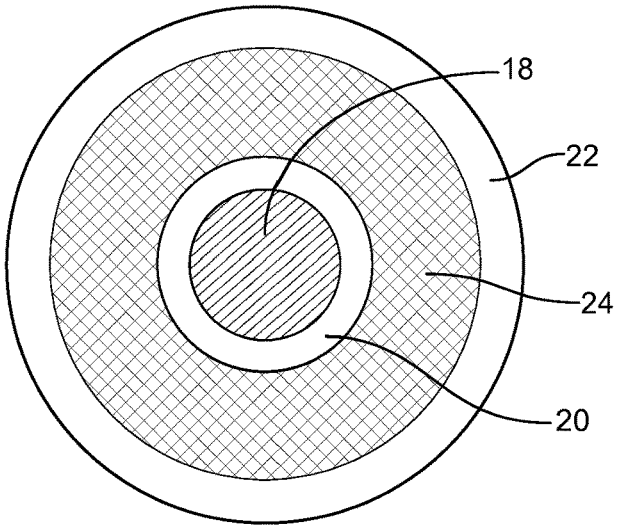
FIG. 3 is a cross-sectional view of the tool extension of FIG. 2, taken along the section line 3-3 in FIG. 2.
Figure 4:
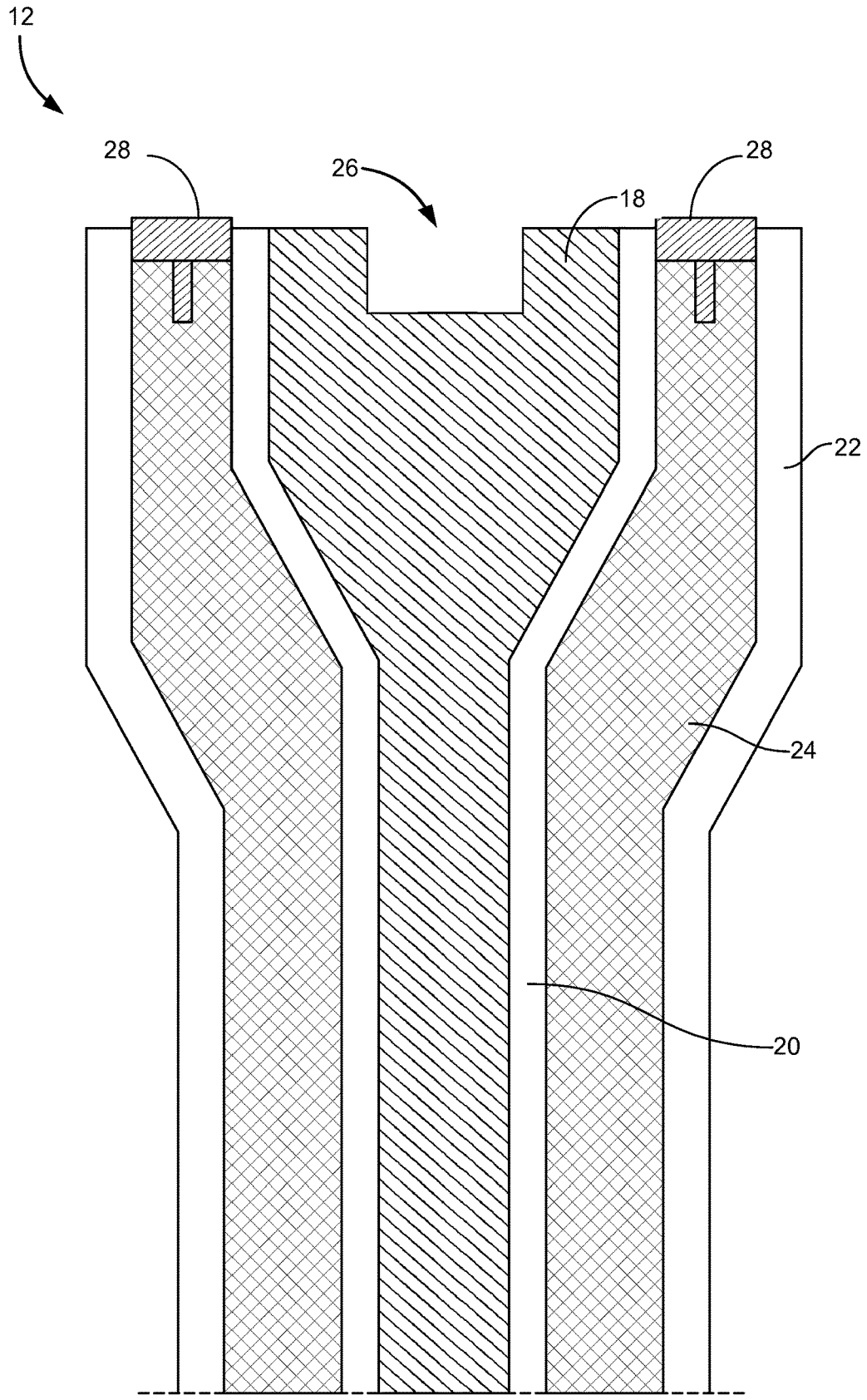
FIG. 4 is another cross-sectional view of the tool extension of FIG. 2, taken along the section line 4-4 in FIG. 2.

Referring now to FIGS. 2-4, several detailed views of the input end 12 of the tool extension 10 are shown. The tool extension 10 includes a bendable drive core 18. The drive core 18 may be illustratively embodied as a shaft or wire of any suitable material and/or configuration that is capable of transferring rotational torque from the input end 12 to the output end 14, as well as bending along its length between the input end 12 to the output end 14. For instance, in the illustrative embodiment of FIGS. 2-4, the drive core 18 is a solid shaft or wire (of varying radius near its ends, see FIG. 4) formed of a metal or metal alloy. In other embodiments, the drive core 18 may be formed of a plurality of braided and/or wound components (e.g., flexible steel wrapped in wire, similar to a guitar string). In still other embodiments, the drive core 18 may be a tightly-wound spring. In yet other embodiments, the drive core 18 may be formed of a series of linked sections such that bending may occur at the joint between each pair of linked sections (even if the linked sections are not flexible along their individual lengths).

As shown in FIGS. 2 and 4, at the input end 12, the drive core 18 may be formed with a recess 26 that is sized to receive the output shaft 17 of the tool 16. For instance, in the illustrative embodiment, the recess 26 has a generally cubic shape adapted to receive a square drive 17. As described above, at the output end 14, the drive core 18 may include a feature that allows a plurality of differently sized tool elements 13 (e.g., sockets, screwdriver bits, or the like) to be interchangeably coupled to the drive core 18. For instance, in the illustrative embodiment, the drive core 18 includes a square drive 11 positioned at the output end 14 of the tool extension 10.

The tool extension 10 also includes a shell surrounding the drive core 18. In the illustrative embodiment of FIGS. 2-4, this shell comprises an inner shell 20 and an outer shell 22. The inner shell 20 surrounds the drive core 18 and is in contact with the drive core 18. As such, in some embodiments, a lubricant may be provided between the drive core 18 and the inner shell 20 to reduce friction between these components when the drive core 18 rotates within the inner shell 20. Additionally or alternatively, the inner shell 20 may be formed of a low-friction material. The outer shell 22 surrounds the inner shell 20, such that a generally annular space is formed between the inner and outer shells 20, 22. At the input end 12 of the tool extension 10, the inner and outer shells 20, 22 are joined by an end plate 28. Similarly, at the output end 14 of the tool extension 10, the inner and outer shells 20, 22 are joined by another end plate (not shown). It is contemplated that, in other embodiments, the shell of the tool extension 10 may have other configurations than that just described. In the illustrative embodiment, both the inner and outer shells 20, 22 are formed of a flexible, insulating material, such as a plastic.

An electro-rheological (ER) fluid 24 is contained in the shell of the tool extension 10. In the illustrative embodiment shown in FIGS. 2-4, the ER fluid 24 is disposed in the annular space formed between the inner and outer shells 20, 22. ER fluids generally comprise small, polarized particles in viscous insulating liquids. As such, when an electric field is applied, an ER fluid may change its rheological characteristics, such as viscosity and/or dynamic yield strength. In the illustrative embodiment, when the ER fluid 24 is exposed to an electric field, the viscosity of the ER fluid 24 will increase dramatically. Additionally or alternatively, applying a compressive force to the ER fluid 24 may increase the viscosity of the ER fluid 24. In these ways, the relative rigidity of the ER fluid 24 may be controlled to transition the ER fluid 24 between a flexible state in which the shell permits bending of the drive core 18 and a rigid state in which the shell resists bending of the drive core 18.

While the ER fluid 24 is generally shown in FIGS. 2-4 as occupying substantially all of the space between the inner and outer shells 20, 22, in other embodiments the ER fluid 24 may be disposed in only portions of the space between the inner and outer shells 20, 22. For instance, the ER fluid 24 might occupy one or more pockets formed between the inner and outer shells 20, 22 (while the remaining portions of the space between the inner and outer shells 20, 22 might be filled with air, or other components).

As best seen in FIG. 4, the end plate 28 of the tool extension 10 may comprise one or more electrodes 28 configured to selectively apply an electric field to the ER fluid 24 to cause the ER fluid 24 to transition from a flexible state to a rigid state. As shown in FIG. 4, the electrode(s) 28 may extend a distance into the space formed between the inner and outer shells 20, 22 and containing the ER fluid 24. In some embodiments, the electrode(s) 28 (or wires connected thereto) may extend along the length of the tool extension 10 to ensure that the electrical field is applied relatively evenly to all portions of the ER fluid 24 when the electrode(s) 28 are supplied with an electric current. The tool extension 10 may include an on-board power source (not shown) positioned near and electrically coupled to the electrode(s) 28. The power source may supply the electrode (s) 28 with electrical current (and, thus, increase the rigidity of the ER fluid 24) in response to a user input, such as a user of the tool extension 10 pressing a button coupled to the power source. In other embodiments, the electrode(s) 28 may be supplied with an electrical current by an external power source that is not a permanent part of the tool extension 10.

So long as the electric field is applied to the ER fluid 24, the increased rigidity of the ER fluid 24 will resist bending of the drive core 18 between the input and output ends 12, 14 of the tool extension 10 (but, generally, will not impede rotation of the drive core 18 inside the inner shell 20). In some embodiments, when the ER fluid 24 is in a rigid state, the shell of the tool extension 10 may apply a normal force to the drive core 18 that promotes the transfer of rotational torque from the input end 12 to the output end 14. After the target fastener 15 has been tightened or loosened using the tool extension 10, the user may release the button coupled to the power source (or, in other embodiments, press the same or a different button) to cause the power source to cease supplying electric current to the electrode(s) 28, which will result in the ER fluid 24 returning to a flexible state. This will allow bending of the drive core 18 between the input and output ends 12, 14, which may increase the ease of removing the tool extension 10 from the space in which it was being used.

Figure 5:
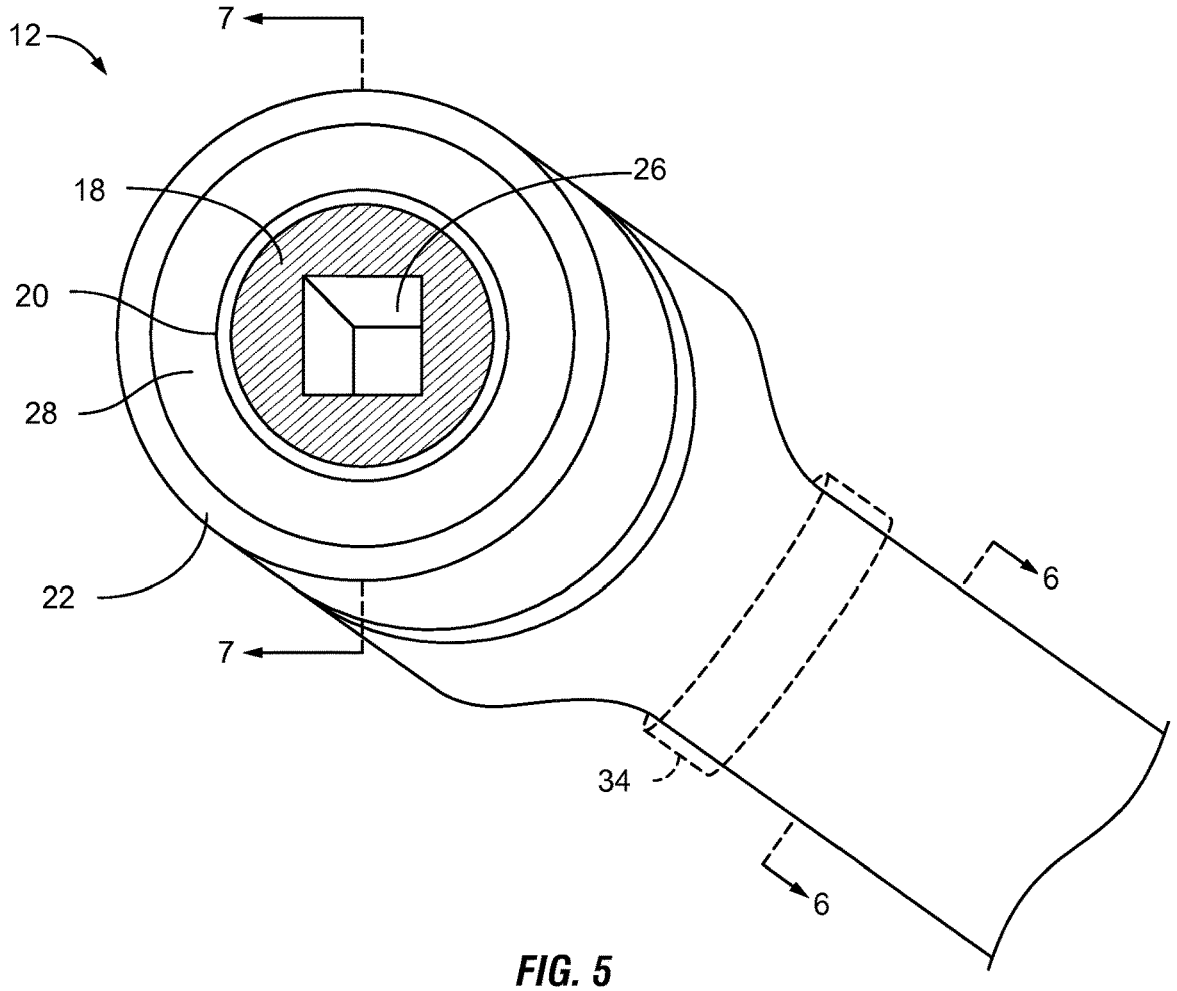
FIG. 5 is a perspective view of an input end of another illustrative embodiment of a tool extension.
Figure 6:
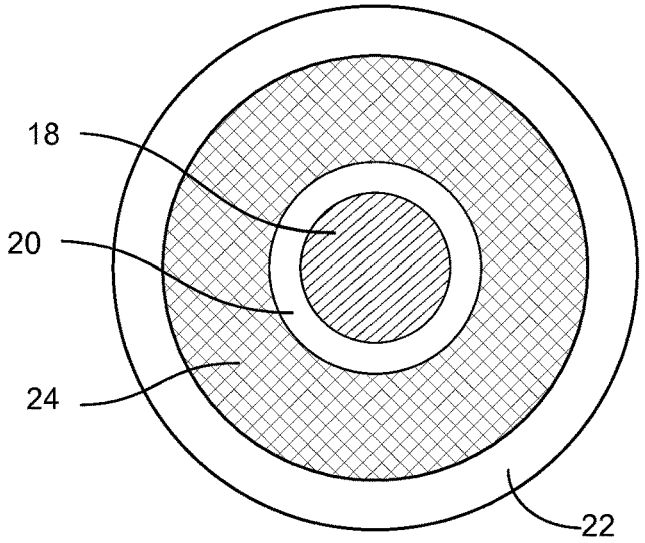
FIG. 6 is a cross-sectional view of the tool extension of FIG. 5, taken along the section line 6-6 in FIG. 5.
Figure 7:
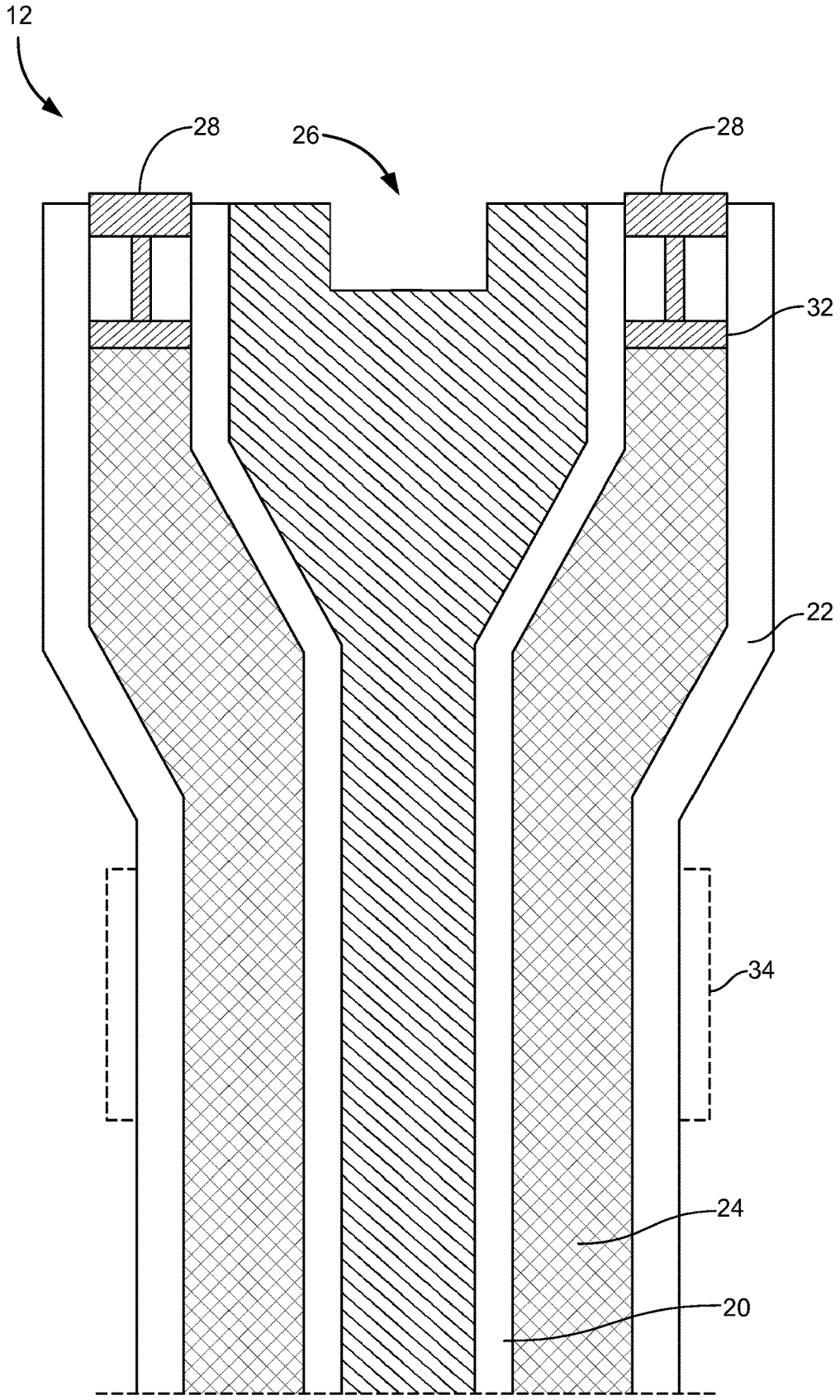
FIG. 7 is another cross-sectional view of the tool extension of FIG. 5, taken along the section line 7-7 in FIG. 5.

Referring now to FIGS. 5-7, several detailed views of the input end 12 of another illustrative embodiment of a tool extension 10 are shown. This tool extension 10 may be removably coupled between a fastener 15 and a tool 16 in the same manner shown in FIGS. 1A and 1B and described in detail above. In the illustrative embodiment shown in FIGS. 5-7, the tool extension 10 has many of the same components as the tool extension 10 shown in FIGS. 2-4. As such, the same reference numerals have been used in FIGS. 5-7 to indicate these components and the description set forth above (with reference is to FIGS. 2-4) is equally applicable to the tool extension 10 of FIGS. 5-7, except as noted below.

Whereas the end plate 28 of the tool extension 10 of FIGS. 2-4 comprised one or more electrodes, the end plate 28 of the illustrative embodiment of the tool extension 10 shown in FIGS. 5-7 comprises one or more actuators 28. As best seen in FIG. 7, the actuator(s) 28 are coupled to an annular ring 32 disposed within the annular space between the inner and outer shells 20, 22. The actuator(s) 28 are operable (either electromechanically or manually) to move the annular ring 32 within the space between the inner and outer shells 20, 22, parallel the length of the tool extension 10. As such, when the actuator(s) 28 move the annular ring 32 toward the output end 14 of the tool extension 10, the annular ring 32 decreases an internal volume of the shell of the tool extension 10, thereby exerting a compressive force on the ER fluid 24 and increasing the viscosity of the ER fluid 24. As such, the actuator(s) 32 may be used to selectively apply a compressive force to the ER fluid 24 to cause the ER fluid 24 to transition from a flexible state to a rigid state.

In some embodiments, the tool extension 10 may additionally or alternatively include one or more cylindrical sleeve actuators 34 positioned around sections of the outer shell 22 (one such sleeve actuator 34 being shown in phantom in FIGS. 5 and 7). The sleeve actuator(s) 34 may be operable (e.g., electromechanically) to contract or squeeze a section of the outer shell 22 to decrease an internal volume of the shell of the tool extension 10, thereby exerting a compressive force on the ER fluid 24 and increasing the viscosity of the ER fluid 24. As such, the sleeve actuator(s) 34 may be used to selectively apply a compressive force to the ER fluid 24 to cause the ER fluid 24 to transition from a flexible state to a rigid state. It is contemplated that, in some embodiments, a tool extension 10 may include both electrode(s) for applying an electrical field to the ER fluid 24 and actuator(s) for applying a compressive force to the ER fluid 24 (which may be operable simultaneously or independently of one another). In such embodiments, the power source used to supply electrical current to the electrode(s) of the tool extension 10 may also be used to drive electromechanical actuators, such as solenoids, included in the tool extension 10.

Figure 8:
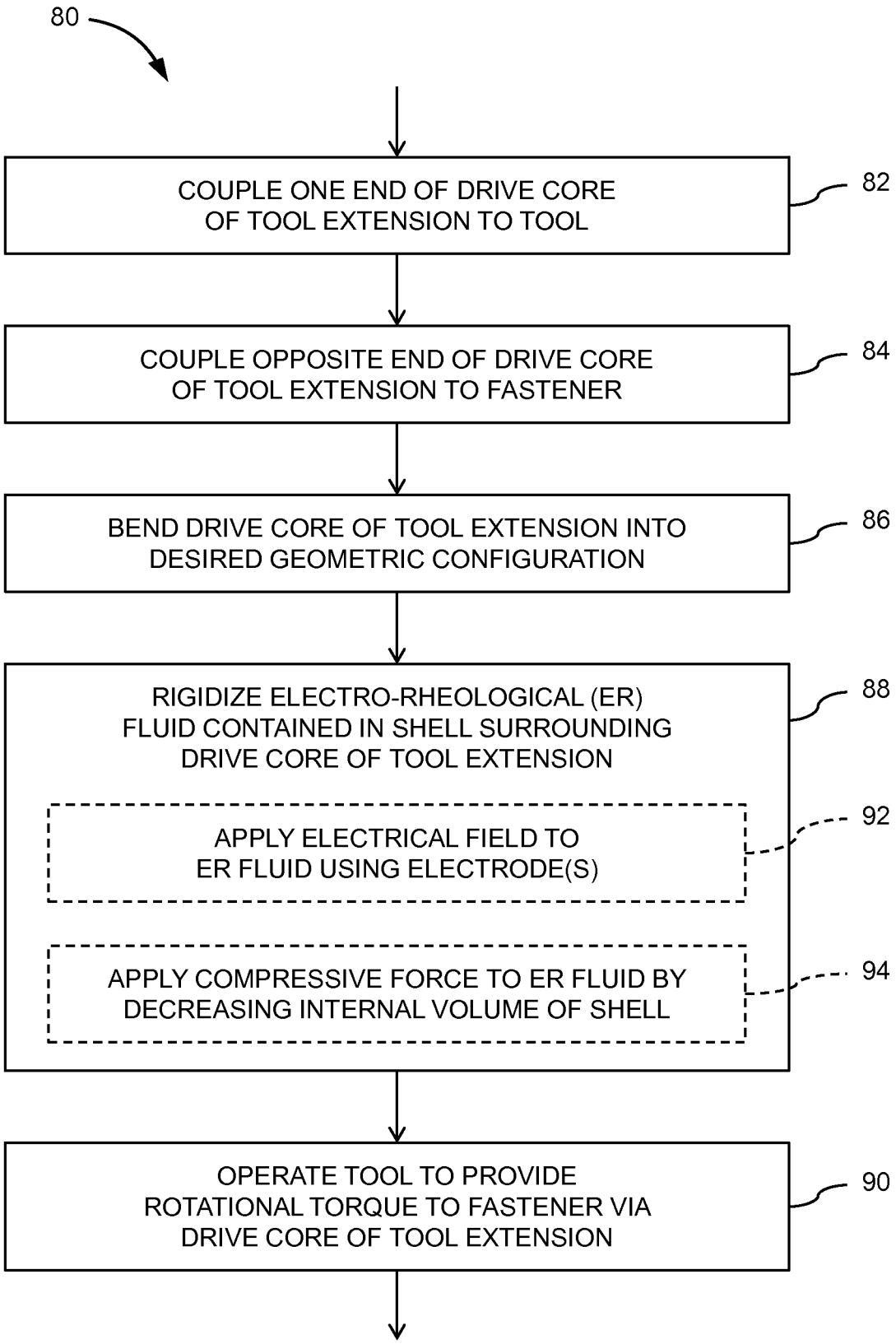
FIG. 8 is a simplified flow diagram of one illustrative embodiment of a method of using one of the tool extensions of FIGS. 2 and 5.

Referring now to FIG. 8, one illustrative embodiment of a method 80 of using a tool extension 10 (for instance, the tool extension 10 of FIGS. 2-4 or the tool extension 10 of FIGS. 5-7) is shown as a simplified flow diagram. The method 80 is illustrated in FIG. 8 as a number of blocks 82-90, each of which may be performed by user of the tool extension 10 and a tool 16.

The method 80 begins with block 82, in which a user removably couples the input end 12 of the drive core 18 of the tool extension 10 to the output 17 of the tool 16. As described above, in some embodiments, the input end 12 of the tool extension 10 may be formed to include a recess 26 that is shaped to receive a square drive 17 of the tool 16. As such, block 82 may involve inserting the square drive 17 of the tool 16 into the recess 26 formed in the drive core 18.

In block 84, a user removably couples the output end 14 of the drive core 18 of the tool extension 10 to the fastener 15. As described above, in some embodiments, the output end 14 of the tool extension 10 may be configured to be indirectly coupled to a fastener 15 via one of a plurality of differently sized tool elements 13. As such, in some embodiments of the method 80, block 84 may involve removably coupling a selected tool element 13 to a square drive 11 of the drive core 18 and removably coupling the selected tool element 13 to the fastener 15.

In block 86, the user bends the tool extension 10 and, hence, the drive core 18 into a desired geometric configuration. This geometric configuration may be any shape that allows the tool extension 10 to extend between the fastener 15 and the tool 16. A certain geometric configuration may be desirable, for instance, to accommodate a particular location of a fastener 15. In some illustrative embodiments, block 86 may involve moving the output end 14 of the tool extension 10 in three dimensions relative to the input end 12 of the tool extension 10. During block 86, the ER fluid 24 of the tool extension 10 remains in a flexible state, such that the shell of the tool extension 10 permits bending of the drive core 18 between the input and output ends 12, 14 of the tool extension 10.

It will be appreciated that the blocks 82-86 of the method 80 may be performed in any order, including performing two or more of blocks 82-86 simultaneously. For instance, in some embodiments of the method 80, a user might first removably couple the input end 12 of the drive core 18 to the tool 16 (block 82), then bend the drive core 18 into the desired geometric configuration (block 86), and then removably couple the output end 14 of the drive core 18 to the fastener 15 (block 84). Furthermore, it is also contemplated that, in some embodiments, one or both of blocks 82, 84 may be performed after block 88.

After block 86, the method 80 proceeds to block 88, in which the user rigidizes the ER fluid 24 contained in the shell surrounding the drive core 18. In other words, in block 88, the ER fluid 24 transitions from a flexible state to a rigid state. In some embodiments (such as those using the tool extension 10 shown in FIGS. 2-4), block 88 may involve block 92, as shown in phantom in FIG. 8. In block 92, an electrical field is applied to the ER fluid 24 using one or more electrodes 28 to cause the ER fluid 24 to increase its rigidity. In some embodiments (such as those using the tool extension 10 shown in FIGS. 5-7), block 88 may involve block 94, as shown in phantom in FIG. 8. In block 94, a compressive force is applied to the ER fluid 24 by decreasing an internal volume of the shell of the tool extension 10 (e.g., using one or more actuators 28, 34) to cause the ER fluid 24 to increase its rigidity. As mentioned above, it is also contemplated that some embodiments of block 88 may involve both applying an electrical field (block 92) and a compressive force (block 94) to the ER fluid 24. In any case, rigidizing the ER fluid 24 in block 88 causes the shell of the tool extension 10 to resist bending of the drive core 18 and, thus, maintains the drive core 18 in the desired geometric configuration established in block 86.

After blocks 82-88 have been performed, the method 80 proceeds to block 90, in which the user operates the tool 16 to provide rotational torque to the fastener 15 via the drive core 18 of the tool extension 10. In particular, operating the tool 16 will cause the output 17 of the tool 16 to rotate. As the input end 12 of the drive core 18 is coupled to the output 17 of the tool 16, this rotation will be transferred to the drive core 18, and the drive core 18 will rotate within the inner shell 20 of the tool extension 10. When the output end 14 of the drive core 18 rotates, this rotation will be transferred to the fastener 15. In some embodiments, rotation may be transferred from the drive core 18 to the fastener 15 indirectly via a tool element 13. After the fastener 15 has been sufficiently tightened or loosened in block 90, the user may cause the ER fluid 24 to transition from the rigid state back to a flexible state to allow for easier removal of the tool extension 10 from the space in which it was being used, as described above.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A tool extension comprising:

a longitudinally extending drive core that extends from a first end to a second end opposite the first end, wherein the first end is removably coupled to a rotating output of a tool to receive rotational torque from the rotating output of the tool, the second end is configured to be removably coupled to a fastener to supply rotational torque to the fastener, and the drive core is bendable between the first and second ends;

a longitudinally extending and cylindrically shaped first shell that surrounds the longitudinally extending drive core;

a longitudinally extending and cylindrically shaped second shell that is spaced apart from and surrounds both the longitudinally extending drive core and the longitudinally extending and cylindrically shaped first shell;

wherein the longitudinally extending drive core transfers rotational torque from the first end to the second end by rotating along its length within the first shell and wherein the longitudinally extending drive core is structured to rotate to an angle greater than 360 degrees;

wherein the longitudinally extending and cylindrically shaped first shell and the spaced apart longitudinally extending and cylindrically shaped second shell form a longitudinally extending and cylindrically shaped chamber there between;

wherein the longitudinally extending and cylindrically shaped chamber surrounds the longitudinally extending and cylindrically shaped first shell and the longitudinally extending drive core;

wherein the longitudinally extending and cylindrically shaped chamber contains electro-rheological (ER) fluid that transitions between a flexible state that permits bending the longitudinally extending and cylindrically shaped first and second shells and the longitudinally extending drive core and a rigid state that resists bending the longitudinally extending and cylindrically shaped first and second shells and the longitudinally extending drive core.

2. The tool extension of claim 1, further comprising one or more electrodes to selectively apply an electric field to the ER fluid to cause the ER fluid to transition from the flexible state to the rigid state.

3. The tool extension of claim 2, further comprising a power source located near the first end of the longitudinally extending drive core, the power source configured to selectively supply an electric current to the one or more electrodes.

4. The tool extension of claim 2, further comprising one or more actuators that selectively apply a compressive force to the ER fluid to cause the ER fluid to transition from the flexible state to the rigid state.

5. The tool extension of claim 4, wherein the one or more actuators selectively apply the compressive force to the E R fluid by altering an internal volume of the shell containing the ER fluid.

6. The tool extension of claim 1, further comprising:

a first end plate joining the longitudinally extending and cylindrical shaped first and second shells at the first end of the longitudinally extending drive core; and a second end plate joining the longitudinally extending and cylindrical shaped first and second shells at the second end of the longitudinally extending drive core.

7. The tool extension of claim 6, wherein at least one of the first and second end plates comprises an electrode configured to selectively apply an electric field to the ER fluid to cause the ER fluid to transition from the flexible state to the rigid state.

8. The tool extension of claim 1, wherein the second end of the longitudinally extending drive core is movable in three dimensions relative to the first end of the longitudinally extending drive core when the ER fluid is in the flexib e state.

9. The tool extension of claim 1, wherein the longitudinally extending and cylindrical shaped first and second shells apply a normal force to the longitudinally extending drive core when the ER fluid is in the rigid state that promotes the transfer of rotational torque from the first end of the longitudinally extending drive core to the second end of the longitudinally extending drive core.

10. The tool extension of claim 1, wherein the second end of the longitudinally extending drive core is removably coupled to one of a plurality of differently sized tool elements to supply rotational torque to the fastener.

11. The tool extension of claim 1 wherein the longitudinally extending drive core comprises a metal or metal alloy.

12. The tool extension of claim 11 wherein the longitudinally extending drive core comprises a wire.

13. The tool extension of claim 1 wherein the longitudinally extending drive core comprises a solid shaft.

14. The tool extension of claim 1 wherein the longitudinally extending drive core comprises a braided component.

15. The tool extension of claim 1 wherein the longitudinally extending drive core comprises wound components.

16. The tool extension of claim 1 wherein the longitudinally extending drive core comprises a series of linked sections.

17. The tool extension of claim 1, further comprising one or more actuators that selectively apply a compressive force to the ER fluid to cause the ER fluid to transition from the flexible state to the rigid state, which further includes a piston actuated by the one or more actuators, the piston structured to selectively apply the compressive force to the ER fluid by altering an internal volume of the shell containing the ER fluid.

18. The tool extension of claim 17, wherein the piston is in the form of an annular ring disposed within an annular space between the first shell and second shell, the annular ring structured to alter an internal volume to exert a compressive force on the ER fluid.

* * * * *